US012546507B2

(12) United States Patent
Sakarwala

(10) Patent No.: US 12,546,507 B2
(45) Date of Patent: Feb. 10, 2026

(54) DRAIN ASSEMBLY FOR HEAT EXCHANGER SYSTEM

(71) Applicant: Rheem Manufacturing Company, Atlanta, GA (US)

(72) Inventor: Ammar K. Sakarwala, Lewisville, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 310 days.

(21) Appl. No.: 18/325,869

(22) Filed: May 30, 2023

(65) Prior Publication Data

US 2023/0392821 A1 Dec. 7, 2023

Related U.S. Application Data

(60) Provisional application No. 63/365,621, filed on Jun. 1, 2022.

(51) Int. Cl.
*F24F 13/22* (2006.01)

(52) U.S. Cl.
CPC ..... *F24F 13/222* (2013.01)

(58) Field of Classification Search
CPC ..... F24F 13/222; F25D 2321/144
See application file for complete search history.

(56) References Cited

U.S. PATENT DOCUMENTS 5,511,386 A * 4/1996 Russ ..... F24F 1/0063 62/297
2011/0016903 A1* 1/2011 Ballet ..... F24F 13/222 62/276

* cited by examiner

*Primary Examiner* — Elizabeth J Martin
(74) *Attorney, Agent, or Firm* — Eversheds Sutherland (US) LLP

(57) ABSTRACT

The present disclosure provides a drain assembly for a heat exchanger system. The drain assembly includes a bracket, a drain pan detachably coupled to the bracket, and a support member detachably coupled to the drain pan. The drain pan defines one or more drain channels extending longitudinally therealong. The support member includes a central portion and two or more arms extending outwardly from the central portion, the two or more arms configured to support a heat exchanger thereon. With such arrangement, at least a portion of the drain pan is disposed between the support member and the bracket, such that load of the heat exchanger is transferred from the support member to the bracket via the drain pan.

21 Claims, 13 Drawing Sheets

DRAIN ASSEMBLY FOR HEAT EXCHANGER SYSTEM

CROSS-REFERENCE TO RELATED APPLICATION

This application claims the benefit of U.S. Application Ser. No. 63/365,621, filed Jun. 1, 2022, the entirety of which is hereby incorporated by reference.

TECHNICAL FIELD

The present disclosure relates, in general, to heat exchanger system and, more specifically relates, to a drain assembly for the heat exchanger system.

BACKGROUND

Indoor heat exchanger coils in residential split air-conditioning ("AC") systems are typically configured as an N-coil, an A-coil, or a V-coil. Present day indoor heat exchanger coils include a drain pan at a center of a base thereof to collect condensate formed on the coil. The drain pan is supported by internal edges of a cabinet of an indoor unit of the split air-conditioning system and the indoor heat exchanger coil is disposed on the drain pan. As such, an entire load of the coil is incident on the drain pan and is transferred to the cabinet. Typically, the drain pan is a plastic molded component. In order to withstand such high load of the coil, the drain pan is designed to include a large cross-sectional area, which demands increased use of plastic material during molding, thereby increasing cost of the drain pan. Additionally, an increase in weight of the drain pan adds to a total weight of the indoor heat exchanger and may render a process of assembling the indoor heat exchanger within the cabinet, complex.

SUMMARY

According to one aspect of the present disclosure, a drain assembly for a heat exchanger system is disclosed. The drain assembly includes a bracket, a drain pan detachably coupled to the bracket, and a support member detachably coupled to the drain pan. The drain pan defines one or more drain channels extending longitudinally therealong. The support member includes a central portion and two or more arms extending outwardly from the central portion, the two or more arms configured to support a heat exchanger thereon. With such arrangement, at least a portion of the drain pan is disposed between the support member and the bracket.

In an embodiment, the bracket includes a first portion at a first end thereof, a second portion at a second end thereof, and a third portion extending between the first portion and the second portion. The first portion is configured to be removably coupled to a first side of a cabinet of the heat exchanger system and the second portion is configured to be removably coupled to a second side of the cabinet. The third portion is configured to support the drain pan thereon. In an embodiment, each of the first portion and the second portion is disposed at an angle with respect to the third portion. In some embodiments, the bracket comprises a metal material.

In an embodiment, the drain pan further includes a longitudinal portion disposed adjacent to the one or more drain channels, an inclined portion extending from an end of the longitudinal portion, and at least one drain opening in fluid communication with the one or more drain channels.

The longitudinal portion is configured to receive at least a portion of the bracket. The inclined portion abuts a first portion of the bracket.

In an embodiment, a height of the longitudinal portion is greater than a height of a peripheral wall of the drain pan. In some embodiments, the drain pan is a molded plastic component.

In an embodiment, each arm of the two or more arms of the support member is inclined at a predefined angle to a central portion of the support member. In some embodiment, the predefined angle is in a range of about 50 degrees to about 80 degrees. In an embodiment, each arm of the two or more arms of the support member is configured to transfer a load of the heat exchanger to the bracket via the drain pan. In an embodiment, the support member is a sheet metal component.

In an embodiment, each arm of the two or more arms of the support member extends toward the one or more drain channels of the drain pan such that condensate from the heat exchanger is directed to the one or more drain channels of the drain pan.

According to another aspect of the present disclosure, a method of assembling a drain assembly in a heat exchanger system is disclosed. The method includes removably coupling a bracket with a cabinet of the heat exchanger system, aligning a longitudinal portion of a drain pan with the bracket, placing the longitudinal portion of the drain pan on the bracket such that an inclined portion of the drain pan abuts an inclined portion of the bracket, and detachably coupling a support member to the drain pan such that at least a portion of the drain pan is disposed between the support member and the bracket. The support member comprising a central portion and two or more arms extending outwardly from the central portion, the two or more arms being configured to support a heat exchanger thereon.

In an embodiment, the method further includes removably coupling a first portion of the bracket with a first side of a cabinet of the heat exchanger system and removably coupling a second portion of the bracket with a second side of the cabinet.

In an embodiment, the method further includes adjusting each arm of the support member to a predefined angle with respect to the central portion of the support member, based on a configuration of a heat exchanger in the heat exchanger system.

According to yet another aspect of the present disclosure, a method of assembling a drain assembly in a heat exchanger system is disclosed. The method includes removably coupling a bracket with a cabinet of the heat exchanger system, and detachably coupling a support member to a longitudinal portion of a drain pan. The support member comprising a central portion and two or more arms extending outwardly from the central portion. The method further includes mounting a V-shaped heat exchanger coil on the support member to form a sub-assembly. The method also includes inserting the sub-assembly into the cabinet such that at least a portion of the drain pan is disposed between the support member and the bracket when the sub-assembly is assembled with the bracket and the cabinet.

In an embodiment, the method further includes aligning the longitudinal portion of a drain pan with a longitudinal length of the bracket.

In an embodiment, the method further includes sliding the longitudinal portion of the drain pan on the bracket until an inclined portion of the drain pan abuts an inclined portion of the bracket.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Figure 1:
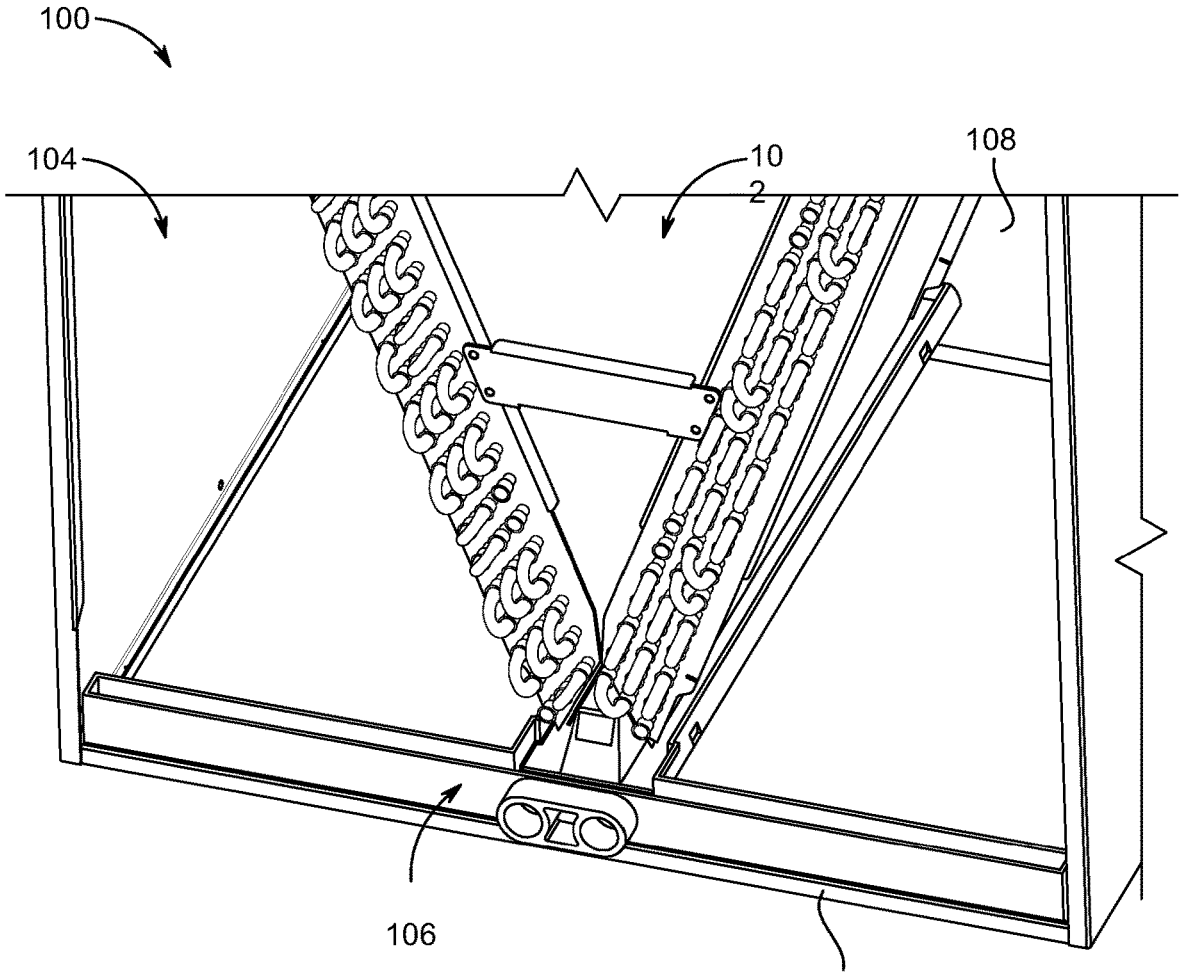
FIG. 1 is a perspective view of a portion of heat exchanger system, according to an embodiment of the present disclosure.

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. Accordingly, when the present disclosure is described as a particular example or in a particular context, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Aspects of the present disclosure relate to a drain assembly for a heat exchanger system which addresses problems associated with conventional drain pans. Referring to FIG.

1, a perspective view of a portion of a heat exchanger system 100 is illustrated. The heat exchanger system 100 may be understood as an air handler or an AC furnace coil implementing a V-shaped heat exchanger coil 102 housed within a cabinet 104. According to an aspect of the present disclosure, the V-shaped heat exchanger coil 102 is disposed on a drain assembly 106 of the heat exchanger system 100. The V-shaped heat exchanger coil 102, the cabinet 104, and the drain assembly 106, without limitation, may together be referred to as the heat exchanger system 100 in the present disclosure. However, it will be understood by a person skilled in the art that the air handler or the AC furnace coil includes multiple other components which are not listed or described here for the purpose of brevity of the present disclosure.

Figure 2A:
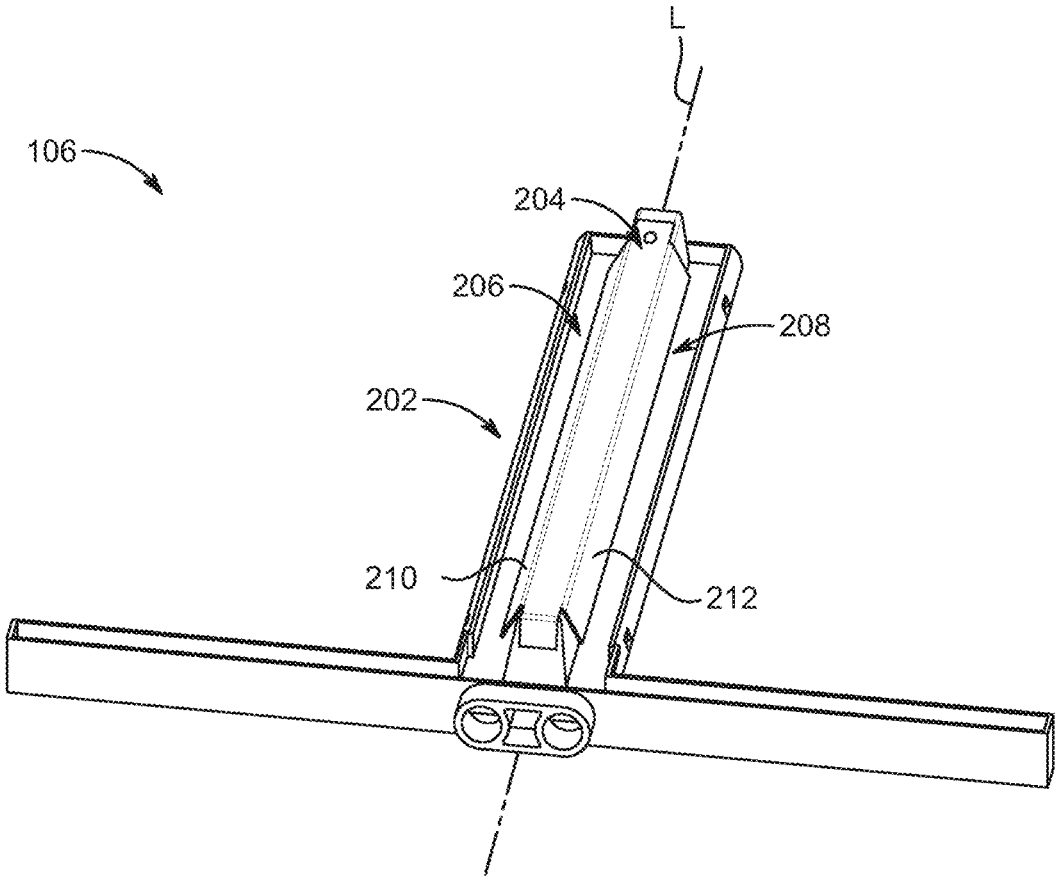
FIG. 2A is a top perspective view of a drain assembly of the heat exchanger system, according to an embodiment of the present disclosure.
Figure 2B:
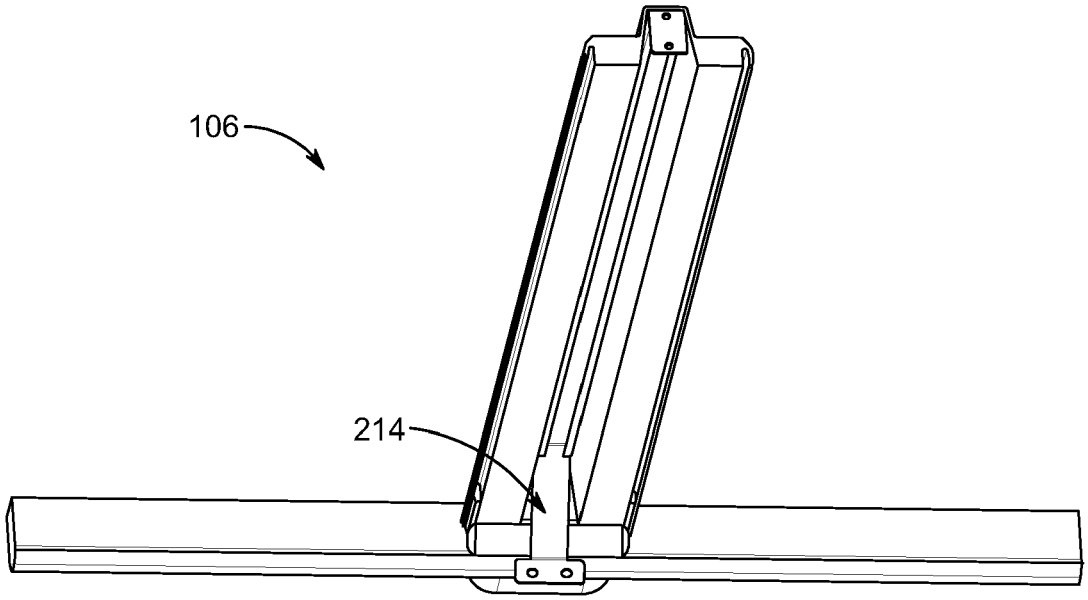
FIG. 2B is a bottom perspective view of the drain assembly, according to an embodiment of the present disclosure.

FIG. 2A illustrates a top perspective view of the drain assembly 106. According to an embodiment of the present disclosure, the drain assembly 106 includes a drain pan 202 configured to drain condensate produced by the V-shaped heat exchanger coil 102 and a support member 204 detachably coupled to the drain pan 202. The drain pan 202 defines one or more drain channels extending longitudinally therealong (i.e., extending parallel to the longitudinal axis "L"). In the illustrated embodiment, the drain pan 202 defines a first drain channel 206 and a second drain channel 208. The support member 204 includes two or more arms, such as a first arm 210 and a second arm 212. In an embodiment, the support member 204 is a corrosion resistant sheet metal component. FIG. 2B illustrates a bottom perspective view of the drain assembly 106. The drain assembly 106 also includes a bracket 214 configured to support the drain pan 202 thereon.

Figure 3:
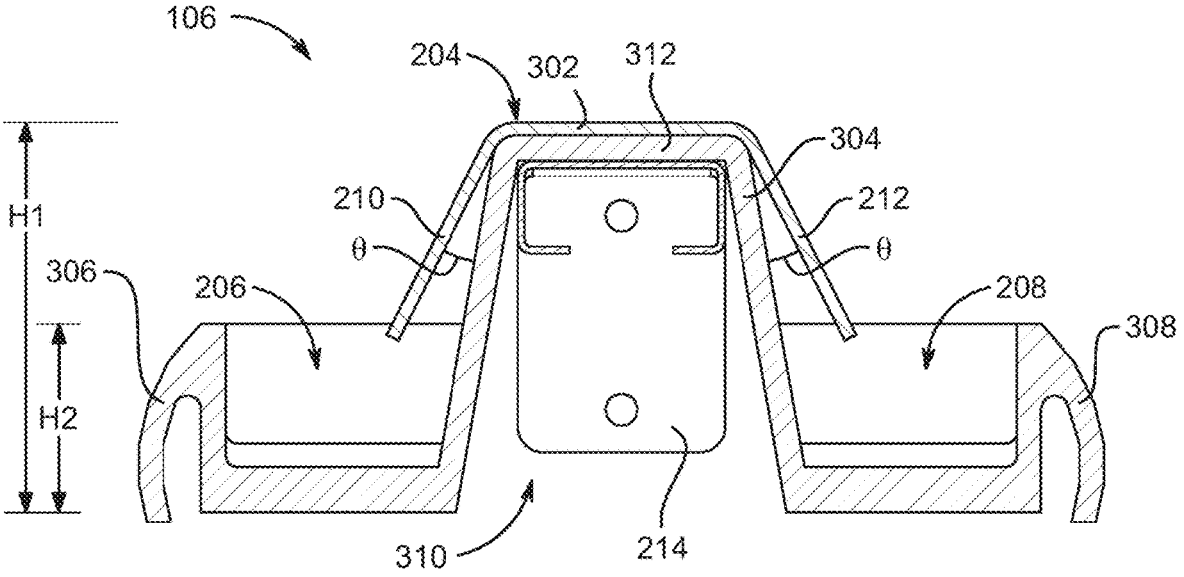
FIG. 3 is a cross-sectional view of the drain assembly, according to an embodiment of the present disclosure.

FIG. 3 illustrates a cross-sectional view of the drain assembly 106. The support member 204 includes a central portion 302, where each of the first arm 210 and the second arm 212 is inclined at a predefined angle "θ" relative to the central portion 302. In an embodiment, the predefined angle "θ" is in a range of about 50 degrees to about 80 degrees. In some embodiments, the predefined angle "θ" may be determined based on a slab angle of the V-shaped heat exchanger coil 102, which is in turn determined based on a height and a width of the cabinet 104. The drain pan 202 includes a longitudinal portion 304 located adjacent to the one or more drain channels. As shown in FIG. 3, the longitudinal portion 304 is located between the first drain channel 206 and the second drain channel 208. In an embodiment, a height "H1" of the longitudinal portion 304 is greater than a height "H2" of a peripheral wall of the drain pan 202. In the illustrated embodiment, the first drain channel 206 is defined between a first peripheral wall 306 and the longitudinal portion 304, and the second drain channel 208 is defined between a second peripheral wall 308 and the longitudinal portion 304. For the purpose of brevity, it is considered that each of the first peripheral wall 306 and the second peripheral wall 308 have same height "H2". With such construction, the central portion 302 of the support member 204 is disposed on the longitudinal portion 304 of the drain pan 202, and each of the first arm 210 and the second arm 212 of the support member 204 extends towards the first drain channel 206 and the second drain channel 208, respectively. The longitudinal portion 304 of the drain pan 202 defines a cavity 310 configured to engage with the bracket 214. Therefore, as seen in FIG. 3, at least a portion of the drain pan 202 (such as a flat surface 312 of the longitudinal portion 304), is sandwiched between the support member 204 (such as the central portion 302) and the bracket 214.

Figure 4:
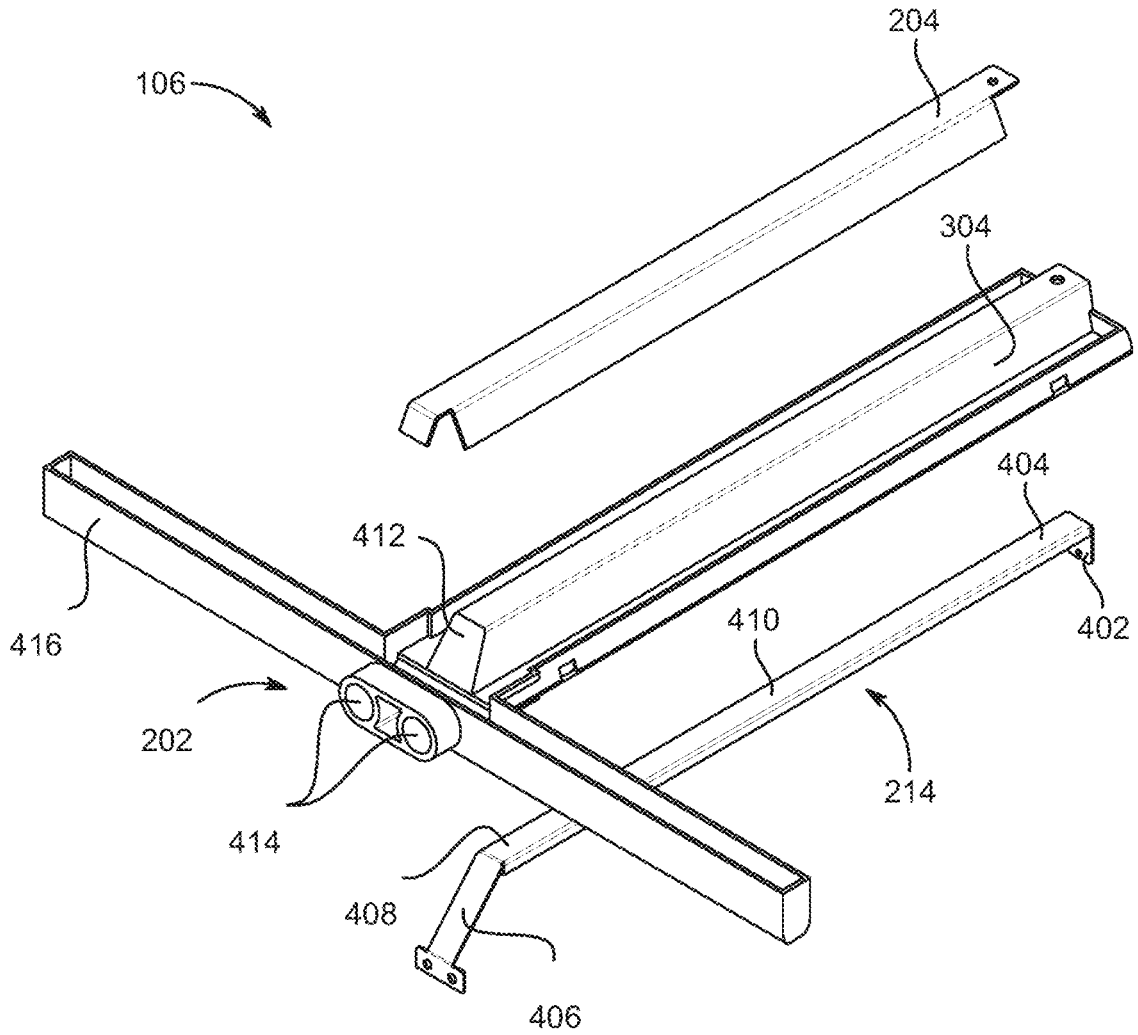
FIG. 4 is an exploded view of the drain assembly, according to an embodiment of the present disclosure.

FIG. 4 illustrates an exploded view of the drain assembly 106. The bracket 214 includes a first portion 402 at a first end 404 thereof and a second portion 406 at a second end 408 thereof. The first portion 402 is configured to removably couple with a first side 108 of the cabinet 104 and the second portion 406 is configured to removably couple with a second side 110 of the cabinet 104. In an embodiment, each of the first portion 402 and the second portion 406 of the bracket 214 is fastened to the cabinet 104.

The bracket 214 also includes a third portion 410 extending between the first portion 402 and the second portion 406 thereof. The third portion 410 is configured to receive the drain pan 202 thereon. Specifically, the third portion 410 is configured to be received in the cavity 310 defined by the longitudinal portion 304 of the drain pan 202, thereby supporting the drain pan 202 thereon. In an embodiment, each of the first portion 402 and the second portion 406 of the bracket 214 is inclined with respect to the third portion 410. Specifically, the first portion 402 is inclined at right angle to the third portion 410 and the second portion 406 is inclined at an obtuse angle with respect to the third portion 410. In an embodiment, the bracket 214 is made of a metal or an alloy.

The drain pan 202 further includes an inclined portion 412 extending from the longitudinal portion 304 and at least one drain opening 414 in fluid communication with the drain channels 206, 208. In an embodiment, an inclination of the inclined portion 412 corresponds to an inclination of the second portion 406 of the bracket 214. In an embodiment, the drain pan 202 is a molded plastic component. The drain pan 202 further includes a lateral arm 416 extending in a direction orthogonal to the longitudinal portion 304. The lateral arm 416 is fluidly connected to the drain channels 206, 208 and the drain opening 414.

Figure 5A:
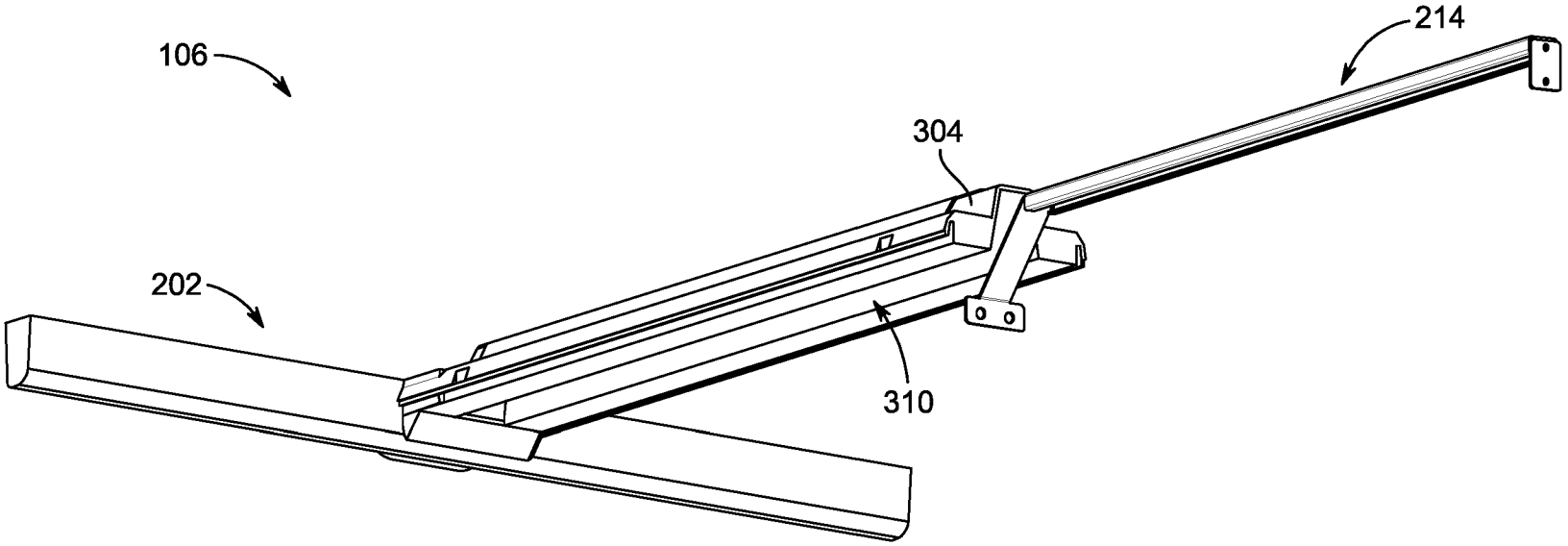
FIG. 5A illustrates a step during assembly of the drain assembly, according to an embodiment of the present disclosure.
Figure 5B:
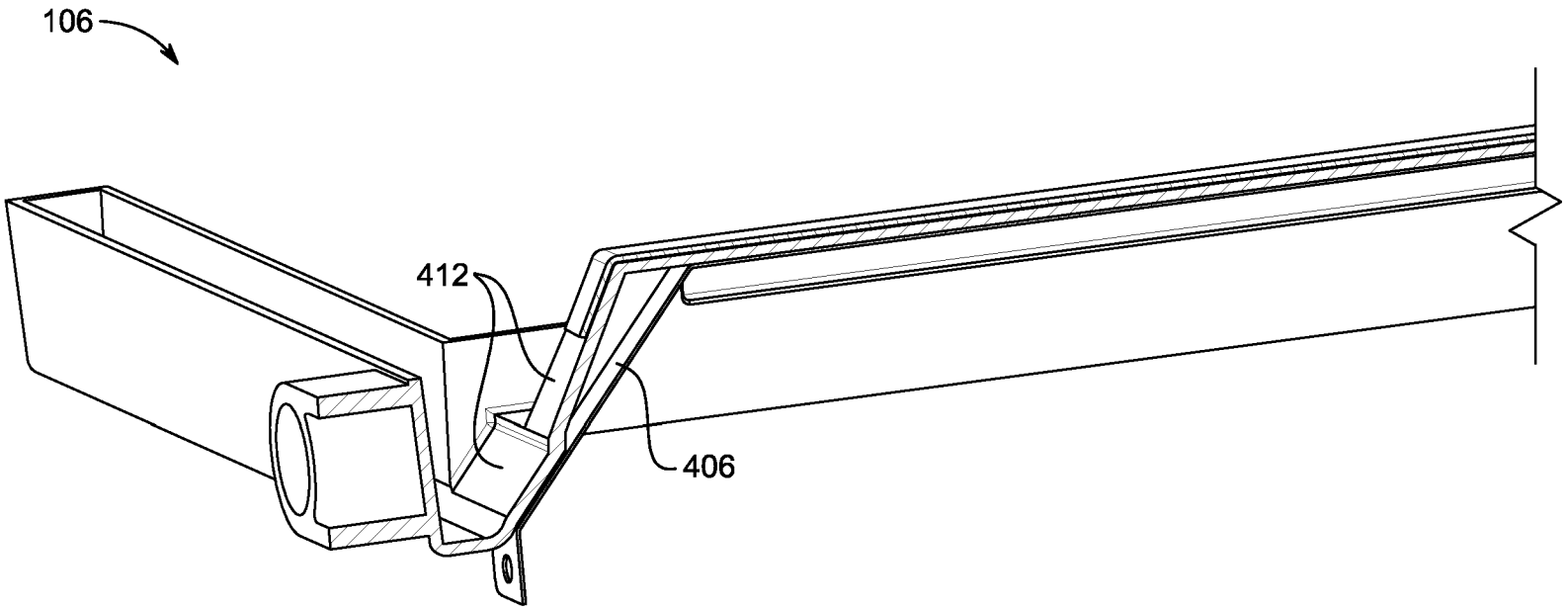
FIG. 5B illustrates another step during assembly of the drain assembly, according to an embodiment of the present disclosure.

FIG. 5A and FIG. 5B illustrate steps of detachably coupling the drain pan 202 to the bracket 214 and are described in conjunction with FIG. 1 through FIG. 4. As described earlier, the bracket 214 is removably fastened to the cabinet 104. The drain pan 202 may then be aligned with respect to the bracket 214. Specifically, the longitudinal portion 304 of the drain pan 202 is aligned with respect to the third portion 410 of the bracket 214, such that the cavity 310 defined by the longitudinal portion 304 may engage with the bracket 214. In an embodiment, the longitudinal portion 304 of the drain pan 202 is configured to slide on the bracket 214. With the bracket 214 being stationary, the drain pan 202, and the support member 204 disposed thereon, may be slid along the third portion 410 of the bracket 214, until the inclined portion 412 of the drain pan 202 abuts the second portion 406 of the bracket 214 (as shown in FIG. 5B). The abutment of the second portion 406 of the bracket 214 and the inclined portion 412 of the drain pan 202 restricts further sliding of the longitudinal portion 304 on the bracket 214.

Figure 6:
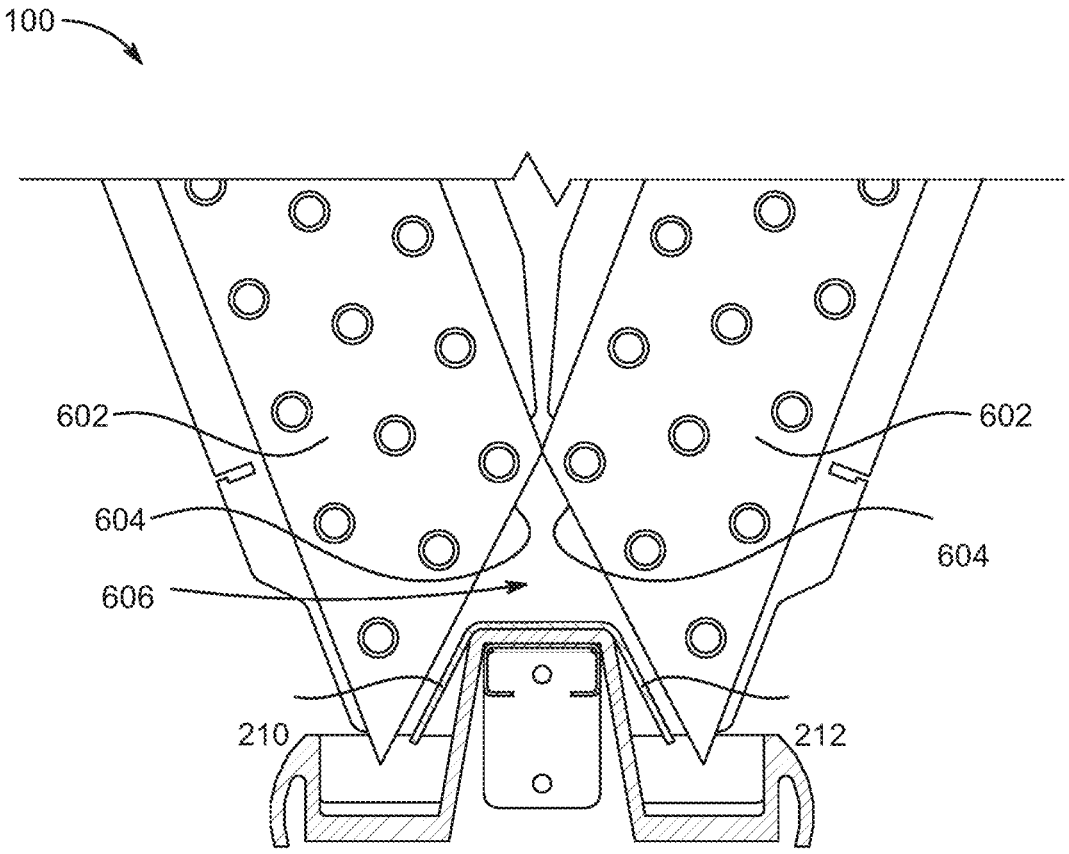
FIG. 6 is a front view of a portion of the heat exchanger system, according to an embodiment of the present disclosure.

FIG. 6 illustrates a front view of a portion of the V-shaped heat exchanger coil 102 disposed on the drain assembly 106. In an embodiment, the V-shaped heat exchanger coil 102 includes fins 602 with cropped ends 604. As used herein, the term "cropped ends" may be understood as truncated ends of the fin 602 cut at a predefined angle with respect to a longitudinal axis of the fin 602. Such cropped ends 604 of the fins 602 in the V-shaped heat exchanger coil 102 defines a space 606 therebetween to accommodate the drain assembly 106. According to an aspect of the present disclosure, each arm (such as the first arm 210 and the second arm 212) of the support member 204 is configured to support the V-shaped heat exchanger coil 102 thereon. Since the support member 204 is a sheet metal component, the inclination of the arms 210, 212 with respect to the central portion 302 of the support member 204 may be adjusted based on a configuration of the space 606, such that the V-shaped heat exchanger coil 102 is seated on the arms 210, 212 of the support member 204.

As such, the arms 210, 212 of the support member 204 are configured to transfer a load of the V-shaped heat exchanger coil 102 to the bracket 214 via the drain pan 202. Further, the load of the V-shaped heat exchanger coil 102 is transferred to the cabinet 104 through the bracket 214. Therefore, the drain pan 202 may not be subjected to heavy loads of the V-shaped heat exchanger coil 102. Such arrangement allows the system to achieve a small cross-sectional area of the drain pan 202, thereby reducing an amount of plastic usage in the heat exchanger system 100. In order to assemble the V-shaped heat exchanger coil 102 within the cabinet 104, the V-shaped heat exchanger coil 102 may be disposed on the support member 204 that is detachably mounted on the drain pan 202 to form a sub-assembly. This sub-assembly may then be slid along the bracket 214 to locate the V-shaped heat exchanger coil 102 within the cabinet 104. Such process reduces an overall assembly time of the heat exchanger system 100.

Figure 7:
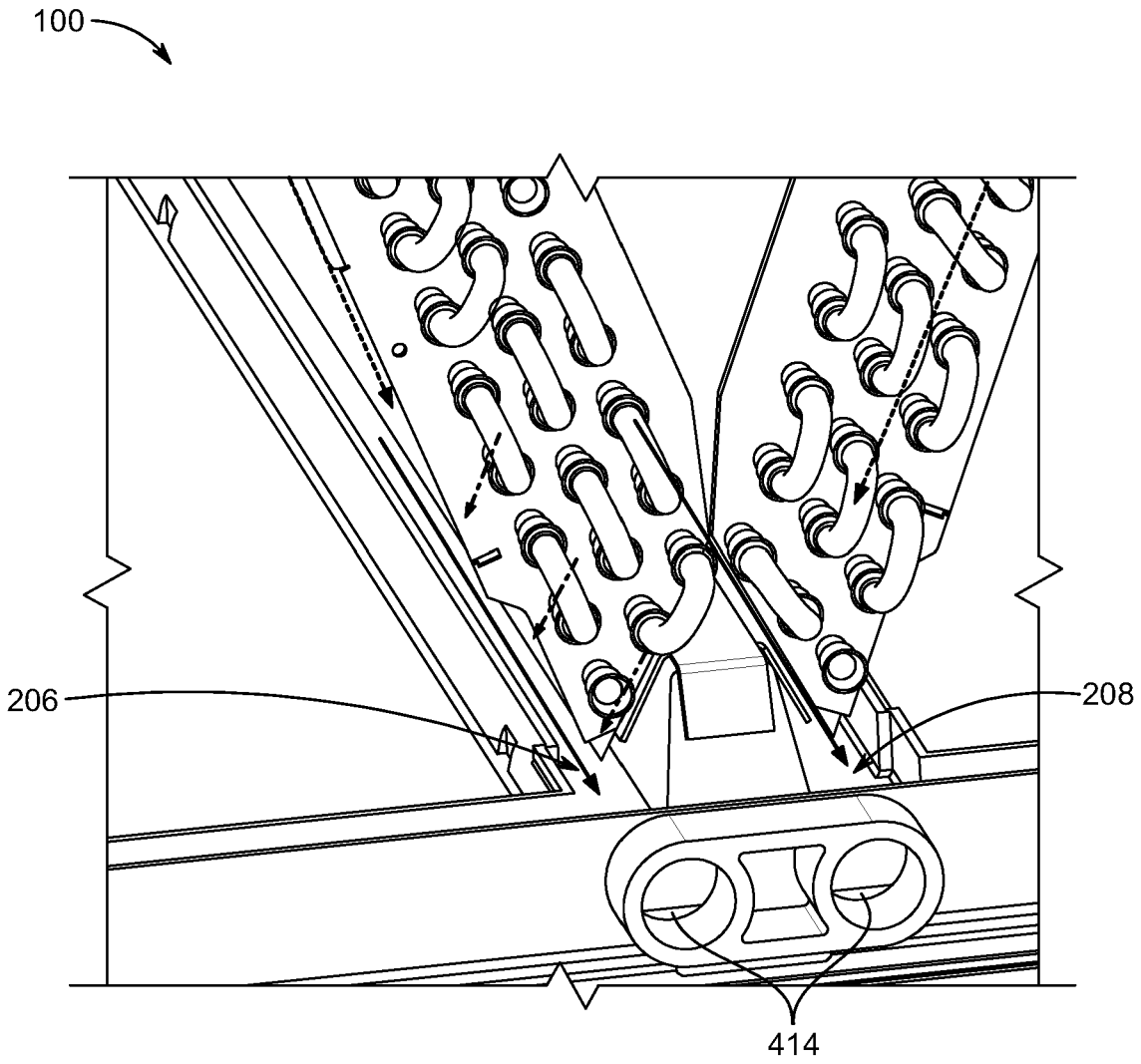
FIG. 7 illustrates the condensate flow path in the heat exchanger system, according to an embodiment of the present disclosure.

FIG. 7 illustrates a perspective view of a portion of the heat exchanger system 100 showing condensate flow path (indicated through arrow headed lines). The arms 210, 212 of the support member 204 extend in a direction towards the drain channels 206, 208. As such, the condensate from the V-shaped heat exchanger coil 102 flows along the fins 602 and collects in the drain channels 206, 208 of the drain pan 202. The collected condensate is drained through the drain opening 414. Therefore, dripping of the condensate to a region in the cabinet 104 below the V-shaped heat exchanger coil 102, may be eliminated.

Figure 8:
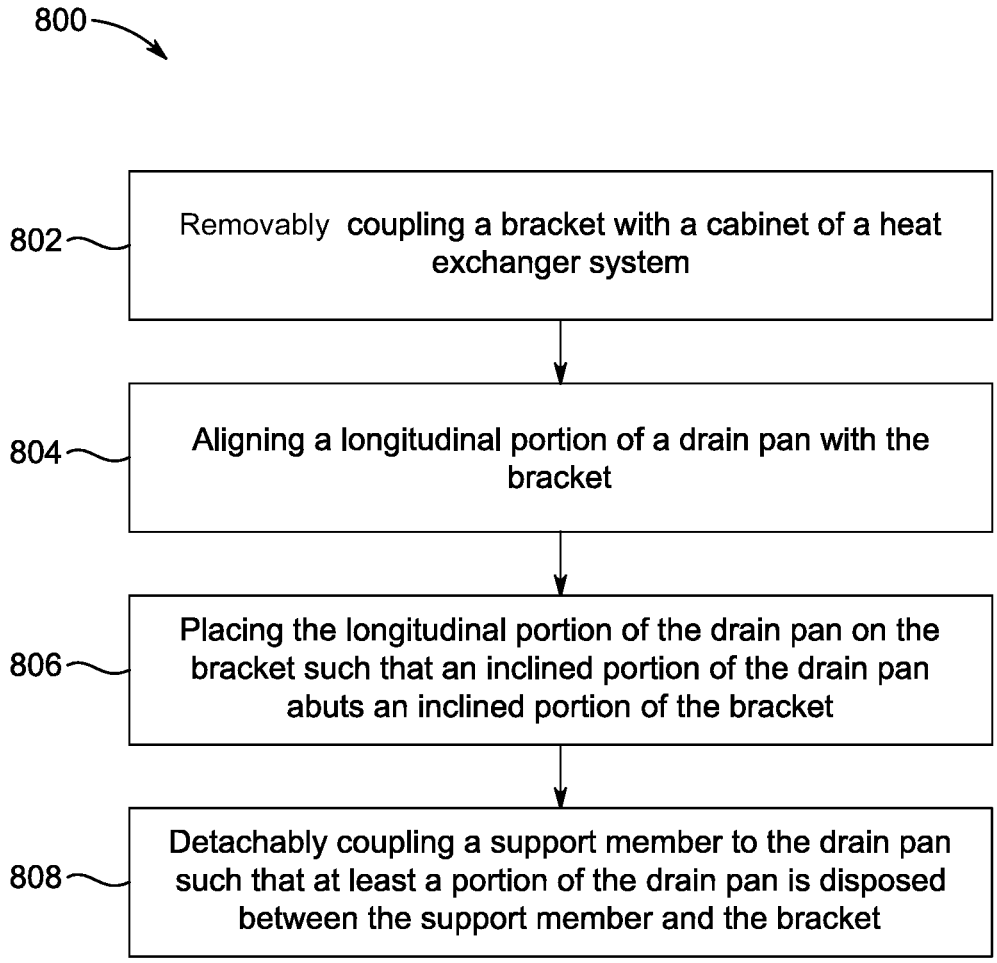
FIG. 8 is a flowchart of a method of assembling the drain assembly in the heat exchanger system, according to an embodiment of the present disclosure.

FIG. 8 illustrates a flowchart of a method 800 of assembling the drain assembly 106 in the heat exchanger system 100, according to aspects of the present disclosure. The method 800 is described in conjunction with FIG. 1 through FIG. 7. At step 802, the method 800 includes removably coupling the bracket 214 with the cabinet 104 of the heat exchanger system 100.

At step 804, the method 800 includes aligning the longitudinal portion 304 of the drain pan 202 with the bracket 214.

At step 806, the method 800 includes placing the longitudinal portion 304 of the drain pan 202 on the bracket 214 such that the inclined portion 412 of the drain pan 202 abuts the second portion 406 of the bracket 214.

At step 808, the method 800 includes detachably coupling the support member 204 to the drain pan 202 such that at least a portion of the drain pan 202 is disposed between the support member 204 and the bracket 214.

Although not specifically shown as steps in FIG. 8, in an embodiment, the method 800 further includes removably coupling a first portion 402 of the bracket 214 with a first side 108 of the cabinet 104 of the heat exchanger system 100 and a second portion 406 of the bracket 214 with a second side 110 of the cabinet 104.

In an embodiment, the method 800 further includes adjusting each arm of the support member 204 to a predefined angle with respect to the central portion 302 of the support member 204, based on a configuration of a heat exchanger in the heat exchanger system 100. In some embodiments, the predefined angle is in a range of about 50 degrees to about 80 degrees.

Figure 9:
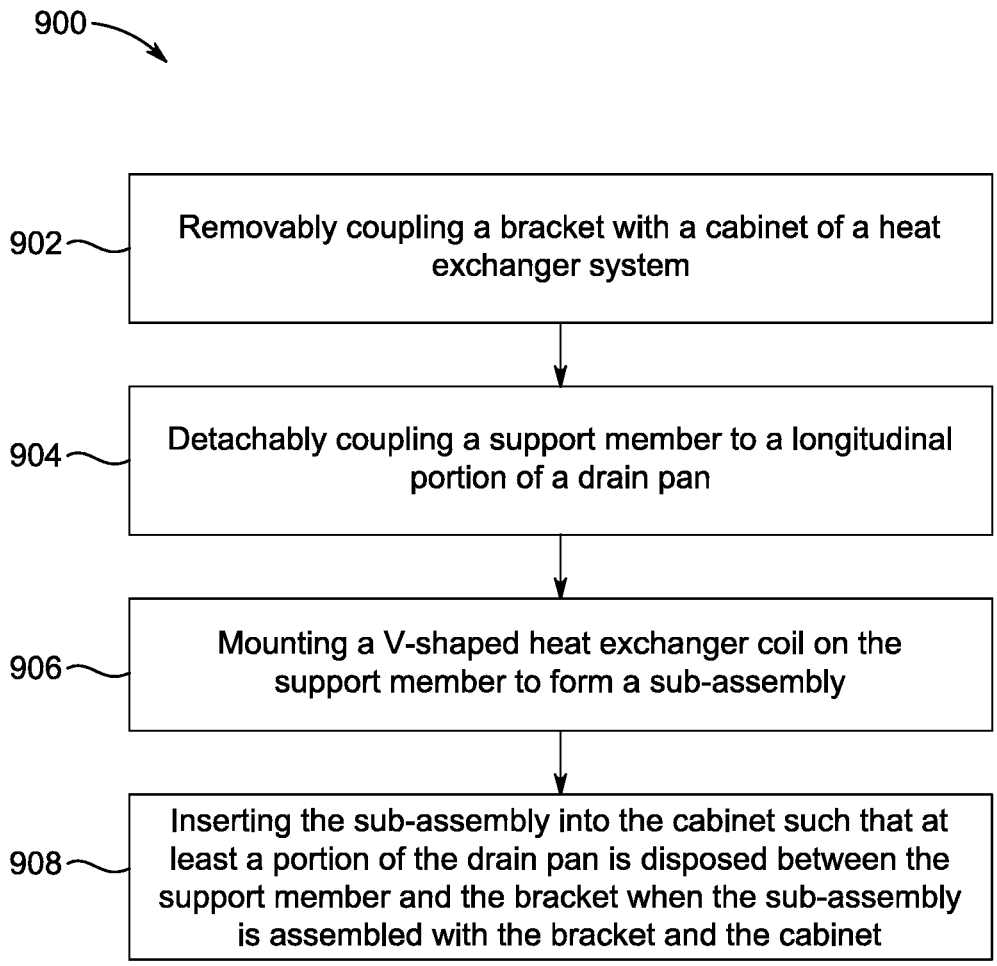
FIG. 9 is a flowchart of a method of assembling the drain assembly in the heat exchanger system, according to another embodiment of the present disclosure.

FIG. 9 illustrates a flowchart of a method 900 of assembling the drain assembly 106 in the heat exchanger system 100, according to aspects of the present disclosure. The method 900 is described in conjunction with FIG. 1 through FIG. 7. At step 902, the method 800 includes removably coupling the bracket 214 with the cabinet 104 of the heat exchanger system 100.

At step 904, the method 900 includes detachably coupling the support member 204 to the longitudinal portion 304 of the drain pan 202.

At step 906, the method 900 includes mounting the V-shaped heat exchanger coil 102 on the support member 204 to form a sub-assembly.

At step 908, the method 900 includes inserting the sub-assembly into the cabinet 104 such that at least a portion of the drain pan 202 is disposed between the support member 204 and the bracket 214 when the sub-assembly is assembled with the bracket 214 and the cabinet 104.

In an embodiment, the method 900 further includes aligning the longitudinal portion 304 of the drain pan 202 with a longitudinal length of the bracket 214. In an embodiment, the method 900 further includes sliding the longitudinal portion 304 of the drain pan 202 on the bracket 214 until the inclined portion 412 of the drain pan 202 abuts the second portion 406 of the bracket 214.

Figure 10:
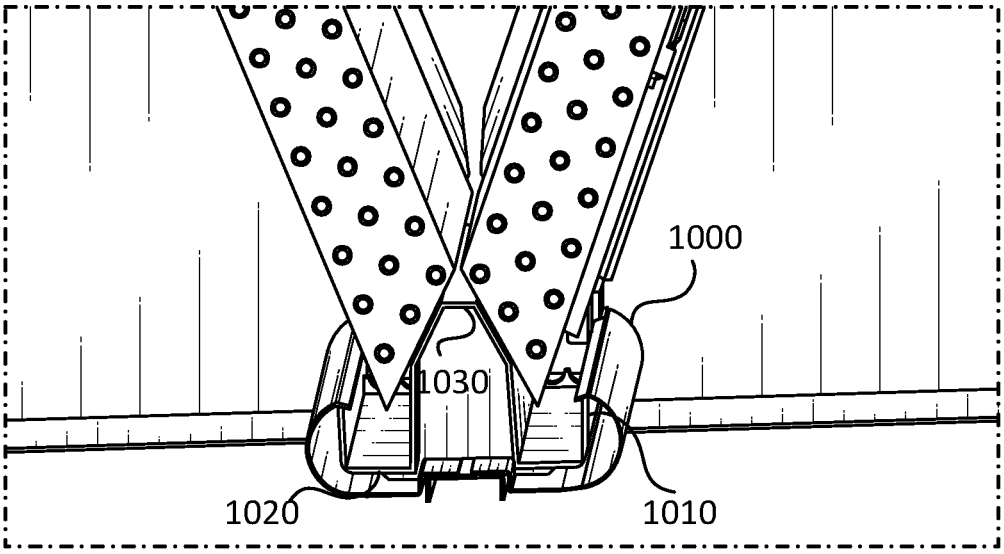
FIGS. 10-12 are various views of a portion of heat exchanger system, according to an embodiment of the present disclosure.
Figure 11:
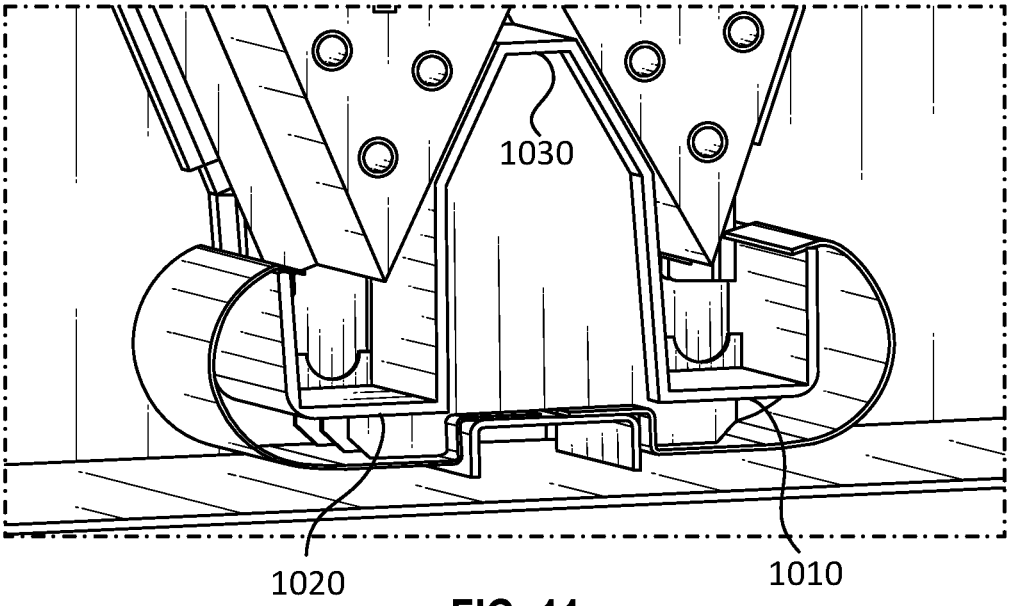
Figure 12:
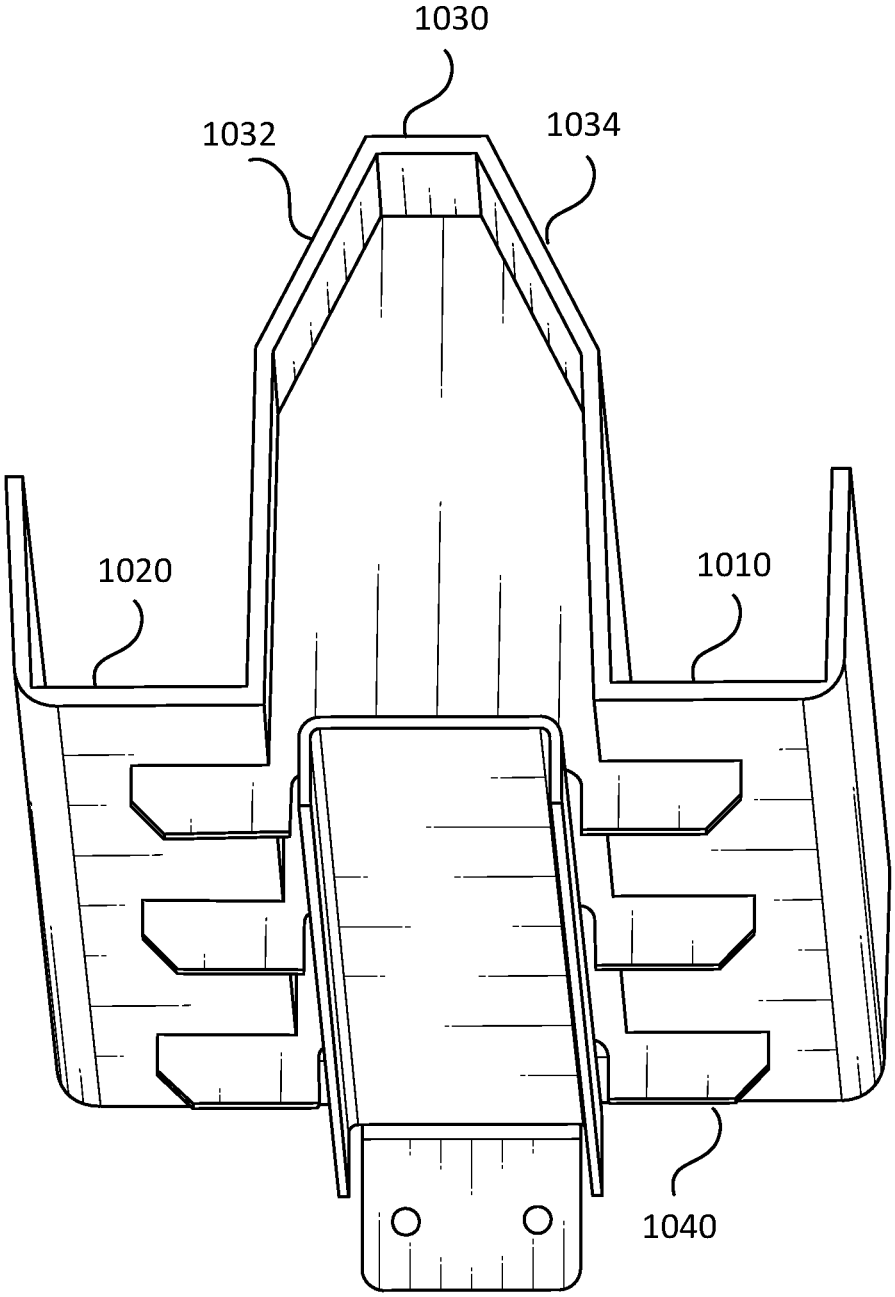

Referring to FIGS. 10-12, a portion of a heat exchanger system is illustrated in various views. The heat exchanger system may be the same heat exchanger system discussed with respect to FIG. 1. The heat exchanger system may be understood as an air handler or an AC furnace coil implementing a V-shaped heat exchanger coil housed within a cabinet. According to an aspect of the present disclosure, the V-shaped heat exchanger coil is disposed on a drain assembly of the heat exchanger system. The V-shaped heat exchanger coil, the cabinet, and the drain assembly, without limitation, may together be referred to as the heat exchanger system 100 in the present disclosure. However, it will be understood by a person skilled in the art that the air handler or the AC furnace coil includes multiple other components which are not listed or described here for the purpose of brevity of the present disclosure.

The heat exchanger system of FIG. 10 may include a drain assembly 1000 configured to drain condensate produced by the V-shaped heat exchanger coil. The drain assembly 1000 may be configured such that no support member is included. The drain assembly 1000 may include a drain pan that defines one or more drain channels extending longitudinally therealong (i.e., extending parallel to the longitudinal axis "L"). In the illustrated embodiment, the drain pan defines a first drain channel 1010 and a second drain channel 1020. As depicted in FIGS. 10-12, the drain assembly 1000 may include a flat upper portion 1030, which may allow for angled surfaces 1032, 1034 to be in contact with portions of the V-shaped heat exchanger coil. As a result, a support member may not be included. The angled surfaces 1032, 1034 may be angled and/or configured based on dimensions of the V-shaped heat exchanger coil. The separation between the angled surfaces 1032, 1034 may at least partially be dependent on a length of the flat upper portion 1030. As depicted at least in FIG. 12, the drain assembly 1000 may include one or more support ribs 1040 disposed on a lower surface.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. A drain assembly for a heat exchanger system, the drain assembly comprising:

a bracket; and a drain pan detachably coupled to the bracket, the drain pan defining one or more drain channels extending longitudinally therealong;

wherein the bracket comprises:

a first portion at a first end thereof, the first portion being configured to be removably coupled with a first side of a cabinet of the heat exchanger system;

a second portion at a second end thereof, the second portion being configured to be removably coupled with a second side of the cabinet of the heat exchanger system; and a third portion extending between the first portion and the second portion, the third portion configured to support the drain pan thereon; and a support member detachably coupled to the drain pan, the support member comprising a central portion and two or more arms extending outwardly from the central portion, the two or more arms configured to support a heat exchanger thereon, wherein at least a portion of the drain pan is disposed between the support member and the bracket.

2. The drain assembly of claim 1, wherein each of the first portion and the second portion is disposed at an angle with respect to the third portion.

3. The drain assembly of claim 1, wherein the bracket comprises a metal material.

4. The drain assembly of claim 1, wherein the drain pan further comprises:

a longitudinal portion disposed adjacent to the one or more drain channels, wherein the longitudinal portion is configured to receive at least a portion of the bracket;

an inclined portion extending from an end of the longitudinal portion, the inclined portion abutting a first portion of the bracket; and at least one drain opening in fluid communication with the one or more drain channels.

5. The drain assembly of claim 4, wherein a height of the longitudinal portion is greater than a height of a peripheral wall of the drain pan.

6. The drain assembly of claim 1, wherein the drain pan is a molded plastic component.

7. The drain assembly of claim 1, wherein each arm of the two or more arms of the support member is inclined at a predefined angle to a central portion of the support member.

8. The drain assembly of claim 7, wherein the predefined angle is in a range of about 50 degrees to about 80 degrees.

9. The drain assembly of claim 7, wherein each arm of the two or more arms of the support member is configured to transfer a load of the heat exchanger to the bracket via the drain pan.

10. The drain assembly of claim 7, wherein each arm of the two or more arms of the support member extends toward the one or more drain channels of the drain pan such that condensate from the heat exchanger is directed to the one or more drain channels of the drain pan.

11. The drain assembly of claim 7, wherein the support member is a sheet metal component.

12. A method of assembling a drain assembly in a heat exchanger system, the method comprising:

removably coupling a bracket with a cabinet of the heat exchanger system;

aligning a longitudinal portion of a drain pan with the bracket;

placing the longitudinal portion of the drain pan on the bracket such that an inclined portion of the drain pan abuts an inclined portion of the bracket; and detachably coupling a support member to the drain pan such that at least a portion of the drain pan is disposed between the support member and the bracket, the support member comprising a central portion and two or more arms extending outwardly from the central portion, the two or more arms being configured to support a heat exchanger thereon.

13. The method of claim 12 further comprising:

removably coupling a first portion of the bracket with a first side of a cabinet of the heat exchanger system; and removably coupling a second portion of the bracket with a second side of the cabinet of the heat exchanger system.

14. The method of claim 12 further comprising:

adjusting each arm of the support member to a predefined angle with respect to the central portion of the support member, based on a configuration of a heat exchanger in the heat exchanger system.

15. The method of claim 14, wherein the predefined angle is in a range of about 50 degrees to about 80 degrees.

16. A method of assembling a drain assembly in a heat exchanger system, the method comprising:

removably coupling a bracket with a cabinet of the heat exchanger system;

detachably coupling a support member to a longitudinal portion of a drain pan, the support member comprising a central portion and two or more arms extending outwardly from the central portion;

mounting a V-shaped heat exchanger coil on the support member to form a sub-assembly; and inserting the sub-assembly into the cabinet such that at least a portion of the drain pan is disposed between the support member and the bracket when the sub-assembly is assembled with the bracket and the cabinet.

17. The method of claim 16 further comprising aligning the longitudinal portion of the drain pan with a longitudinal length of the bracket.

18. The method of claim 16 further comprising sliding the longitudinal portion of the drain pan on the bracket until an inclined portion of the drain pan abuts an inclined portion of the bracket.

19. The method of claim 16, wherein the drain pan defines one or more drain channels extending longitudinally therealong, and wherein each arm of the two or more arms of the support member extends toward the one or more drain channels of the drain pan such that condensate from the V-shaped heat exchanger coil is directed to the one or more drain channels of the drain pan.

20. A drain assembly for a heat exchanger system, the drain assembly comprising:

a bracket; and a drain pan detachably coupled to the bracket, the drain pan defining one or more drain channels extending longitudinally therealong;

wherein the bracket comprises:

a first portion at a first end thereof, the first portion being configured to be removably coupled with a first side of a cabinet of the heat exchanger system;

a second portion at a second end thereof, the second portion being configured to be removably coupled with a second side of the cabinet of the heat exchanger system; and a third portion extending between the first portion and the second portion, the third portion configured to support the drain pan thereon; and wherein the drain pan further comprises:

a longitudinal portion disposed adjacent to the one or more drain channels, wherein the longitudinal portion is configured to receive at least a portion of the bracket; and at least one drain opening in fluid communication with the one or more drain channels.

21. The drain assembly of claim 20, wherein the drain pan further comprises:

an inclined portion extending from an end of the longitudinal portion, the inclined portion abutting a first portion of the bracket.

* * * * *